United States Patent [19]

Wenkman et al.

[11] 4,219,130

[45] Aug. 26, 1980

[54] DISPENSING UNIT FOR ELONGATED ARTICLES

[75] Inventors: Gregory J. Wenkman, Madison; Edwin A. Filipowicz, Greenfield, both of Wis.

[73] Assignee: Traex Corporation, Madison, Wis.

[21] Appl. No.: 165

[22] Filed: Jan. 2, 1979

[51] Int. Cl.[3] ..... B65H 3/34

[52] U.S. Cl. ..... 221/202

[58] Field of Search ..... 221/202, 205, 289, 143–149, 221/203

[56] References Cited

U.S. PATENT DOCUMENTS

| | | | |
|---|---|---|---|
| 2,310,933 | 2/1943 | Burger | 221/205 |
| 3,412,896 | 11/1968 | Baller | 221/289 X |

*Primary Examiner*—Stanley H. Tollberg

*Attorney, Agent, or Firm*—Isaksen, Lathrop, Esch, Hart & Clark

[57] ABSTRACT

A dispensing unit for elongated articles is disclosed including a pair of dispensing members which are operated by hand to dispense articles from a storage bin through a dispensing port. The dispensing members are structured so as to cooperate with the interior walls of the storage bin, and also with a sorting tab mounted on the interior thereof, to ensure that the articles waiting to be dispensed from within the unit are properly aligned in the storage bin adjacent the dispensing port so that jamming of the objects inside of the storage bin is prevented.

7 Claims, 6 Drawing Figures

DISPENSING UNIT FOR ELONGATED ARTICLES

BACKGROUND OF THE INVENTION

1. Field of the Invention

The present invention relates to dispensing units in general, and, in particular, to manually operated devices for dispensing elongated articles from a reservoir of such articles.

2. Description of the Prior Art

The prior art is generally cognizant of receptacles for dispensing elongated articles in which a tab or arm is depressed by a user so as to dispense a single elongated article, such as a drinking straw, match, or cigarette. The prior art is also generally cognizant of such dispensing units in which a pivotably mounted member carries a single one of the articles from inside of the unit to outside thereof. One example of such a unit is shown in U.S. Pat. No. 1,008,867. Other examples of apparatus design for dispensing such elongated articles are shown in U.S. Pat. Nos. 592,105, 1,229,982, 1,676,109, 1,678,355, and 1,773,329. While some of the prior art devices have suitable means for preventing jamming of the articles at the exterior of the storage portion of the unit, it has been a problem with some of the prior art devices in that the articles may, on occasion, jam inside of the storage area for the articles, so that the jam is not accessible to the user of the unit.

SUMMARY OF THE INVENTION

The present invention is summarized in that a dispensing unit for a plurality of elongated articles having a fixed cross-sectional diameter includes a rectangular storage bin for receiving the articles therein having at least one dispensing port formed therein, a bottom bracket installed in the storage bin so as to bias the articles to roll toward the dispensing port, a dispensing member mounted in the storage bin adjacent the dispensing port therein so as to be pivotable between a rest and a dispensing position, a support shelf on the dispensing member for supporting the objects thereon, a carrying portion of the dispensing recessed downward from the support shelf and extending out of the dispensing port, a pinch bar on the dispensing member extending from the support shelf and spaced over the carrying portion, and a sorting tab mounted on the interior of the storage bin above the dispensing port and located so that the distance between the sorting tab and pinch bar in its rest position is greater than the diameter of the articles and less than two such diameters.

It is an object of the present invention to construct a dispensing unit for elongated articles in which the possibility of the objects jamming within the unit is reduced to the greatest extent practicable.

It is another object of the present invention to provide such a unit including means therein to periodically jostle the articles within the storage bin so that the proper alignment of the articles for sequential dispensing is maintained at all times.

It is yet another object of the present invention to provide such a dispensing unit that is both efficient in its operation and economical to manufacture.

Yet other objects, advantages, and features of the present invention will become apparent from the following specification when taken in conjunction with the accompanying drawings.

DESCRIPTION OF THE PREFERRED EMBODIMENT

Figure 1:
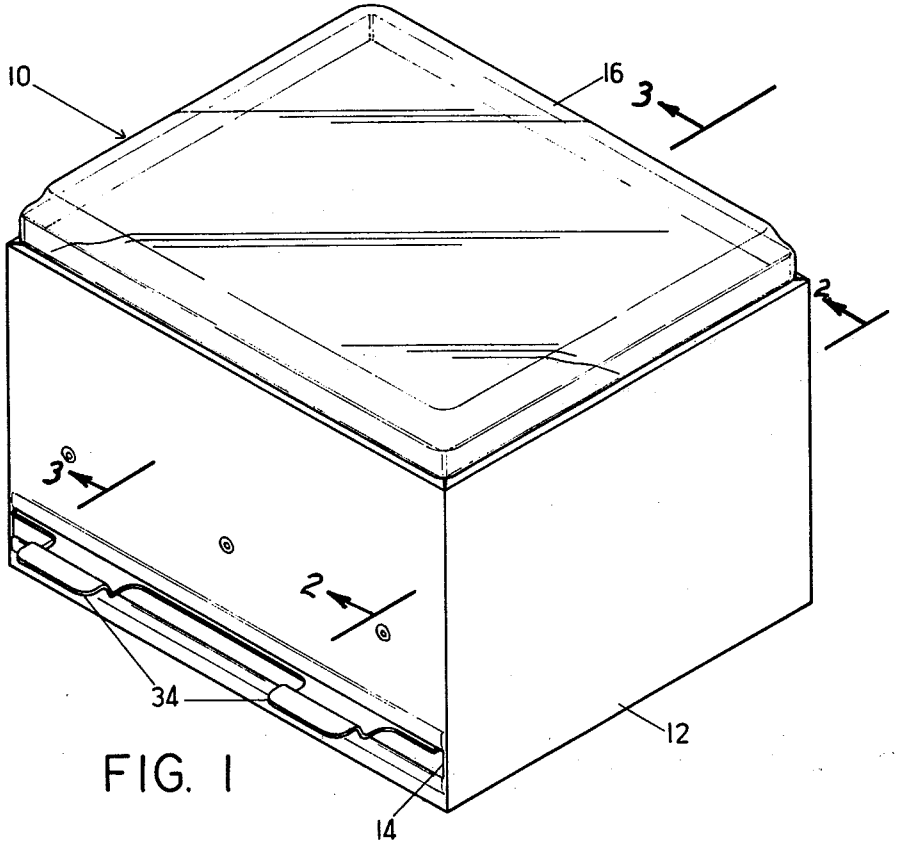
FIG. 1 is a perspective view of a dispensing unit constructed in accordance with the present invention.

Shown in FIG. 1 is a dispensing unit for dispensing elongated articles, generally indicated at 10, constructed in accordance with the present invention. The dispensing unit 10 includes a generally rectangular storage bin 12 which has a pair of dispensing ports 14 formed in it along the lower edges of each of its longer sides. The storage bin 12 has an open top onto which a removable top closure 16 is fitted, with the removable top closure 16 being preferably formed of a transparent material. The top closure 16 is fully removable from the top of the storage bin 12.

Figure 2:
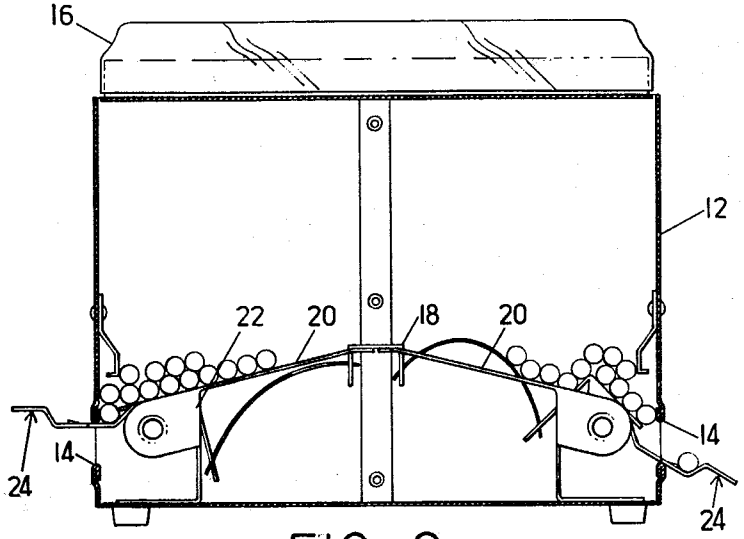
FIG. 2 is a cross-sectional view taken along the line 2—2 in FIG. 1.
Figure 3:
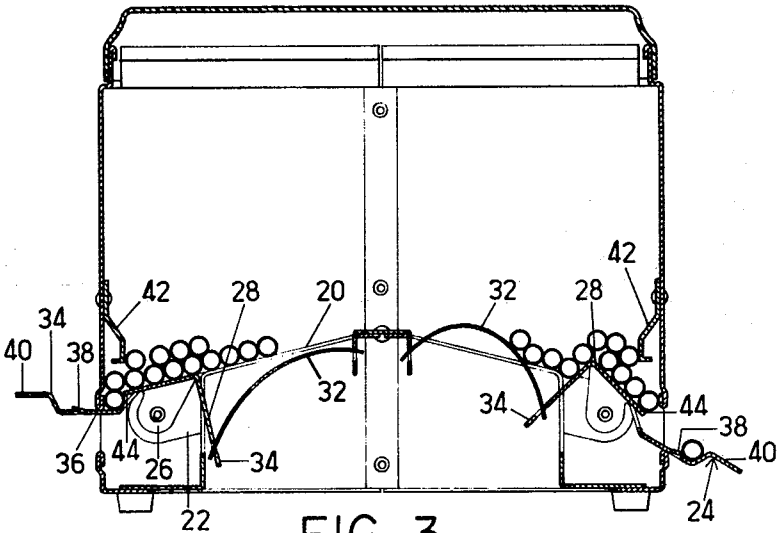
FIG. 3 is a cross-sectional view taken along the line 3—3 in FIG. 1.

As can be seen in the cross-sectional views of the dispensing unit 10 as shown in FIGS. 2 and 3, the organization of the interior of the storage bin 12 is generally symmetrical about a center axis. Along that center axis a center bracket 18 is formed of a generally U-shape, with the center bracket 18 extending the complete longitudinal distance of the storage bin 12 along the center line thereof. The center bracket 18 is located a substantial distance upward from the bottom of the storage bin 12. Attached to the center bracket 18 are a pair of bottom brackets 20 which generally taper downward in a slanted direction from the center bracket 18 toward the dispensing ports 14. At their interior ends the bottom brackets 20 are each fixedly joined to the center bracket 18. At their other ends the bottom brackets 20 are each bent vertically downward until they contact the bottom of the storage bin 12, after which they are bent again so as to line on the interior of the bottom of the storage bin 20 to which they are there attached. A pair of forwardly extending hinge tabs 22 are formed extending from the longitudinal ends of the vertically extending portions of each of the bottom brackets 20. Extending between the hinge tabs 22 on each side of the interior of the storage bin 12 and extending out of the dispensing ports 14 are a pair of respective dispensing members, indicated at 24. The dispensing members 24 each has a hinge tab 26 extending downwardly in a vertical plane from each of the extreme longitudinal ends thereof so as to be received fixedly and rotatably within the hinge tabs 22 of the bottom brackets 20, as is better seen in FIG. 3. The dispensing members 24 each includes a longitudinally extending thin, planar, support shelf 28 extending between the hinge tabs 26. A pair of spring arms 30 are formed extending downward at right angles relative to the support shelves 28 and have openings formed near the bottom ends thereof. A leaf spring 32 is provided extending from the opening in each of the two spring arms 30 on each dispensing member 24 to correspondingly located openings in the center bracket 18 and openings are provided in the bottom brackets 20 to allow the springs 32 to extend therethrough when flexed as shown in FIGS. 2 and 3. Toward its front surface, the dispensing members 24 are each provided with a pair of outwardly extending dispensing tabs 34 extending through the respective dispensing ports 14. The dispensing tabs 34 each include a recessed carrying portion 36 which is recessed somewhat downwardly from the plane of the support shelf 28 and which extends outwardly through the dispensing port 14 beyond the exterior lateral wall of the storage bin 12. A small retaining ridge 38 extends upwardly from the carrying portion 36 exterior of the outside wall of the storage bin 12. A pressing pad 40 is provided at the extreme end of the dispensing tabs 34, upraised slightly from the carrying portions 36, and is arranged at an angle and provided with a size convenient for pressing by the finger of a user. On the interior lateral side walls of the storage bin 12, above each of the dispensing ports 14, a pair of sorting tabs 42 are fastened to the interior of these walls. The sorting tabs 42 are each fixedly attached to the interior wall of the storage bin 12 and then depend downwardly and outwardly therefrom and have their lower ends bent at a right angle back toward that wall at a fixed distance above the support shelf 28. The distance at which the sorting tabs 42 as separated from the support shelf 28, with the dispensing member 24 positioned in its rest position as shown in the left hand side of each of FIGS. 2 and 3, is selected so as to be greater than the diameter of the articles to be dispensed, but less than, the length of two diameters of such articles. Underneath and aligned with each of the sorting tabs 42 above each of the support shelves 28, is a pinch bar 44 which is formed as a small extension of the support shelf 28 positioned spaced above the carrying portion 36. The length of the pinch bars 44 is selected so as to terminate a distance from the interior wall of the storage bin 12 which is slightly greater than the diameter of the articles to be dispensed, but less than two such diameters, when the dispensing member 24 is in its rest position, as shown on the left hand side of FIGS. 2 and 3 dispensing unit 10.

As can be seen in FIGS. 2 and 3 a pair of the dispensing members 24 are provided in each dispensing unit 10 on opposite side of the storage bin corresponding with the location of the dispensing ports 14. The dispensing members 24 are shown in each of FIGS. 2 and 3 in both of their two operating positions. The left hand dispensing member 24 in each of FIGS. 2 and 3 is shown in its rest position, and the right hand dispensing member 24 in each of FIGS. 2 and 3 shown in its dispensing position. As can be seen from these two figures, the limit of level of the pivoting dispensing members 24 is limited by the perimeter of the dispensing ports 14 inasmuch as the carrying portions 36 of the dispensing members 24 contact the opposite edges of the storage bin 12 forming upper and lower edge of the dispensing port 14 in its rest and dispensing positions.

In its operation the dispensing unit 10 allows elongated articles to be dispensing one at a time from each of the dispensing ports 14. The articles to be dispensed, as illustrated in the embodiment disclosed herein are drinking straws, but it is contemplated that any similar elongated articles may be dispensed from the dispensing unit 10. As can be seen in the left hand side of each of the FIGS. 2 and 3, the straws awaiting to be dispensed are received on the support shelf 28. A single straw, which will be the next straw to be dispensed, is received on the carrying portion 36 beneath the pinch bar 44 and just inside of the side wall of the storage bin 12. The straw which is next in turn for being dispensed is received just above the pinch bar 44, resting on the straw beneath, and directly beneath the sorting tab 42. To operate the dispensing unit 10 the user simply presses on the pressing pad 44 of either of the dispensing tabs 34 on the respective dispensing member 24. This pressure pivots the dispensing member 24 from its rest position, as shown in the left hand side of FIGS. 2 and 3, to its dispensing position, as shown on the right hand side of FIGS. 2 and 3. The pivoting of the dispensing member 24 to its dispensing position causes the straw that was already on the carrying portion 36 to be freed from the inside of the storage bin 12, so that it rolls down the carrying portion 36 and over the retaining rib 38. A straw is shown in this position in the right hand side of each of FIGS. 2 and 3. The retaining rib 38 acts to ensure that the straw may not roll backward along the carrying portion 36 to cause a possible jam. Only one straw may be dispensed at this time with each operation because of the provision for the pinch bar 44, which projects under the next succeeding straw so that it may not also be dispensed at the same time. Thus, as the pressure is released on the pressing pad 40, the resilience of the leaf springs 32 causes the dispensing member 24 to pivot from its dispensing portion to its rest position, carrying the dispensed straw on the carrying portion 36 beyond the retaining rib 38. The user may then remove the straw from the carrying portion 36 and use it for its intended purpose. As the dispensing member 24 pivots toward its rest position, the pinch bar 44 recedes away from the inside edge of the storage bin 12 so that the next succeeding straw may drop down onto the carrying portion 36 so as to be dispensed upon the next operation of the dispensing member 24.

The trouble free operation of the dispensing unit 10 is insured by the provision for the sorting tabs 42. The sorting tabs 42 prevent two straws at a time from occupying the position just above the pinch bars 44. This prevents the sort of jam that on occasion occurs in some dispensing machines when two articles both become wedged into opening wide enough to accommodate only one of the articles. In the dispensing unit 10, the only narrow passage is between the pinch bar 44 and the wall of the storage bin 12 and the sorting tabs 42 allow only one straw at a time to proceed down the support shelf 28 and over the pinch bars 44. Thus, an orderly line of straws awaiting to be dispensed is maintained at all times, and jam free operation is assured. The intermittant pivoting of the support shelf 28, in turn, insures that no straws are jammed between the sorting tabs 42 and the pinch bars 44.

In addition, the provision for the leaf springs 32 also helps to insure that the straws are properly aligned as they come toward the dispensing port 14. As can be seen in the right hand side of FIGS. 2 and 3, when the dispensing member 24 is rotated to its dispensing position, the leaf springs 32 are bowed, and extend up above the plane of the bottom bracket 20. These bowed portions of the leaf springs 32 jostle any straws which may be located in that portion of the storage bin 12. Straws so jostled tend to roll evenly down the bottom bracket 20 toward the dispensing member 24. This prevents any straws which may have a tendency not to roll, because of some uneven construction or some material adhering to their exterior, from not rolling down the bottom bracket and also helps to ensure that the straws are properly aligned as they arrive at the dispensing member 24.

Figure 4:
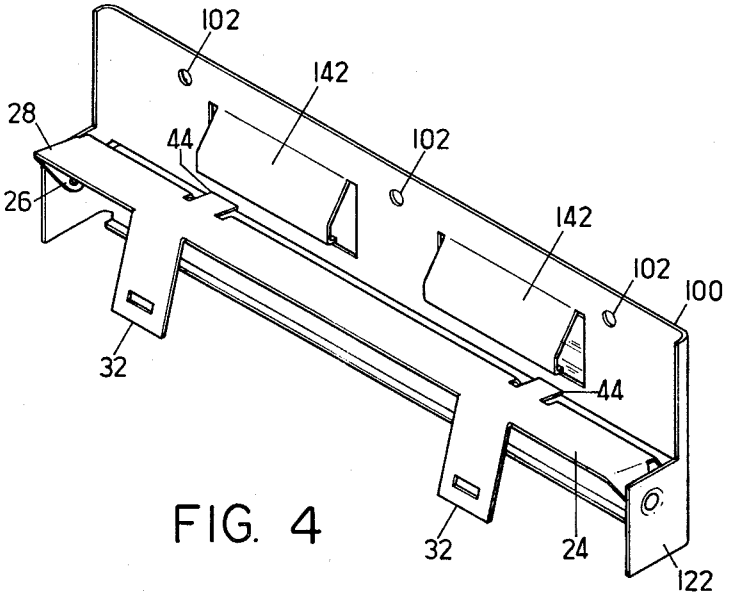
FIG. 4 is a rear perspective view of an alternative embodiment of a dispensing member and sorting tab construction suitable for use in the dispensing unit of FIG. 1.

Shown in FIG. 4 is an alternative arrangement for securing the dispensing member 24 in a pivotable manner in the dispensing unit 10. The dispensing member 24 shown in FIG. 4 is in all respects identical to the dispensing members 24 in FIGS. 1–3. However, the dispensing member 24 of FIG. 4, rather than being pivotally secured to the hinge tabs 22 on the bottom bracket 20, is pivotally secured to a separate bracket assembly 100. The bracket assembly 100, which is secured to the interior of the storage bin 12 through suitable bolts or other fastening means applied through holes 102, has a pair of hinge tabs 122 extending rearwardly from the ends thereof. The hinge tabs 26 of the dispensing member 24 are rotatably secured to the hinge tabs 122 of the bracket assembly 100. The bracket assembly 100 also includes the two sorting tabs 142 thereon, the sorting tabs 142 being formed as cut out and deformed portions of the bracket assembly 100. The dispensing member 24 as shown in FIG. 4 operates in a manner similar to that shown in FIGS. 1–3, with the difference between them being only in the manner in which the dispensing member 24 is mounted, and the manner in which the sorting tabs 142 are formed.

Figure 5:
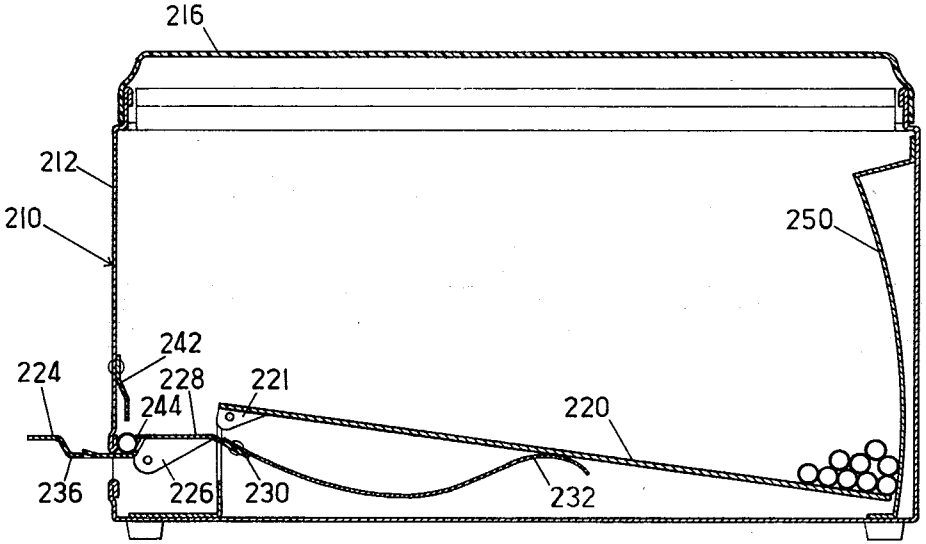
FIG. 5 is a cross-sectional view of an alternative embodiment of a dispensing unit constructed in accordance with the present invention.
Figure 6:
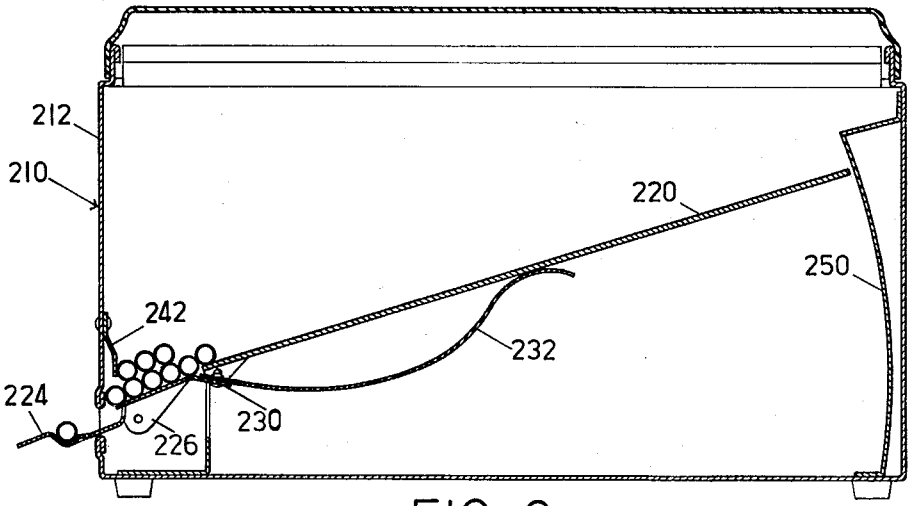
FIG. 6 is a cross-sectional view of the dispensing unit of FIG. 5 with the dispensing member being depressed to its dispensing position.

Shown in FIGS. 5 and 6 is another alternative embodiment of the present invention. In this embodiment a dispensing unit, generally indicated at 210, includes a storage bin 212 with a cover 216. In this embodiment, a bottom bracket 220 is pivotably mounted through the use of a pivot tab 221 which is secured to a bracket 223 attached to the bottom of the storage bin 212. The bottom bracket 220 thus is able to pivot about its forwardmost end. A dispensing member 224 is provided in the dispensing unit 210 and includes a pair of downwardly depending hinge tabs 226 which are pivotally secured to the interior side walls of the storage bin 212. Above the hinge tabs 226 a support shelf 228 is formed and a pair of spring arms 230 extend rearwardly from the rearward edge of the support shelf 228. Each of the spring arms 230 has a respective leaf spring 232 attached thereto with the other end of the leaf spring 232 resting against the underside surface of the bottom bracket 220. Also formed on the dispensing member 224 is a carrying portion 236 which terminates in a dispensing tab in an arrangement similar to the dispensing member 24 of FIGS. 1–3. Also similarly to the embodiment shown in FIGS. 1–3, a pair of pinch bars 244 extends forwardly from the support shelf 228, and a pair of sorting tabs 242 are provided mounted on the interior wall of the storage bin 212 above the dispensing member 224. At the end of the storage bin 212 opposite from the dispensing member 224, a retaining shield 250 is mounted inside of the storage bin 212. The retaining shield 250 is curved so as to correspond approximately with the travel of the rearward end of the bottom bracket 220.

In its operation the dispensing unit 210 of FIGS. 5 and 6 is very similar to the operation of the dispensing unit 10 of FIGS. 1–3. The main difference in its operation is the provision for the tilting bottom bracket 220. As can be seen in FIG. 6, when the dispensing member 224 is pivoted to its dispensing position, the leaf spring 232 acts on the bottom of the bottom bracket 220 to tilt the bottom bracket 220 so that the straws thereon roll toward the dispensing member 224. The retaining shield 250 acts to prevent the articles on the bottom bracket 220 from rolling beyond the reach of the bottom bracket 220. Otherwise the operation of the dispensing unit 210 is similar to that of the operation of the dispensing unit 10 of FIGS. 1–3.

It is understood that the present invention is not limited to the particular construction and arrangement of parts disclosed and illustrated herein, but embraces all such modified forms of the invention as come within the scope of the following claims.

We claim:

1. A dispensing unit for a plurality of elongated articles having a fixed cross-sectional diameter comprising:

a rectangular storage bin for receiving the articles therein having at least one dispensing port formed therein;

a bottom bracket installed in the storage bin so as to bias the articles to roll toward the dispensing port;

a dispensing member mounted in the storage bin adjacent the dispensing port therein so as to be pivotable between a rest and a dispensing position;

a support shelf on the dispensing member for supporting the articles thereon;

a carrying portion of the dispensing member recessed downward from the support shelf and extending out of the dispensing port;

a pinch bar on the dispensing member extending from the support shelf and spaced over the carrying portion;

a storing tab mounted on the interior of the storage bin above the dispensing port and located so that the distance between the sorting tab and the pinch bar in its rest position is greater than the diameter of the articles and less than two such diameters;

a pair of spring arms formed on the dispensing member; and a pair of leaf springs each attached to a one of the springs arms and positioned under the bottom bracket so as to both resiliently bias the dispensing member toward its rest position and jostle the articles resting on the bottom bracket so that the articles will tend to roll toward the dispensing member.

2. A dispensing unit as claimed in claim 1 wherein the bottom bracket is pivotally mounted at one end thereof and wherein the leaf springs are received underneath the bottom bracket so that the bottom bracket is tilted as the dispensing member is pivoted to roll the articles toward the dispensing member.

3. A dispensing unit as claimed in claim 1 wherein a retaining rib is formed on the carrying portion of the dispensing member so that articles which are carried on the carrying portion exterior of the storage bin may not roll back toward the storage bin.

4. A dispensing unit as claimed in claim 1 wherein hinge tabs are formed extending forwardly from the bottom bracket, and wherein hinge tabs are also formed extending downward from the ends of the support shelf of the dispensing member, the hinge tabs of the dispensing member being pivotally secured to the hinge tabs of the bottom bracket.

5. A dispensing unit as claimed in claim 1 wherein a bracket assembly is provided including the sorting tabs thereon and including hinge tabs at the ends thereof and wherein hinge tabs are formed at the ends of the dispensing member, the hinge tabs of the dispensing member being pivotally secured to the hinge tabs of the bracket assembly.

6. A dispensing unit for a plurality of elongated articles having a fixed cross-sectional diameter comprising:

a rectangular storage bin for receiving the articles therein having at least one dispensing port formed therein;

a bottom bracket installed in the storage bin so as to bias the articles to roll toward the dispensing port;

a dispensing member mounted in the storage bin adjacent the dispensing port therein so as to be pivotable between a rest and a dispensing position;

a support shelf on the dispensing member for supporting the articles thereon;

a carrying portion of the dispensing member recessed downward from the support shelf and extending out of the dispensing port;

a pinch bar on the dispensing member extending from the support shelf and spaced over the carrying portion;

a sorting tab mounted on the interior of the storage bin above the dispensing port and located so that the distance between the sorting tab and the pinch bar in its rest position is greater than the diameter of the articles and less than two such diameters;

a pair of spring arms formed on the dispensing member;

a pair of leaf springs each attached to a one of the springs arms so as to resiliently bias the dispensing member toward its rest position; and the bottom bracket having a pair of recesses formed in it so that the leaf springs may extend therethrough when flexed by the operation of the dispensing member so that the leaf springs may jostle the articles so that they will roll toward the dispensing member.

7. A dispensing unit as claimed in claim 6 wherein a center bracket extends through the storage bin and wherein the ends of the leaf springs opposite from the ends secured to the spring arms are secured to said center bracket.

* * * * *